United States Patent [19]

Greene

[11] 4,327,865

[45] May 4, 1982

[54] ASSEMBLY FOR SECURING A RAIL TO A SUPPORTING TIE

[76] Inventor: John L. Greene, 2832 Woodland Dr., Northbrook, Ill. 60062

[21] Appl. No.: 153,184

[22] Filed: May 27, 1980

[51] Int. Cl.[3] ..... E01B 9/00

[52] U.S. Cl. ..... 238/310; 238/287; 238/349; 238/375

[58] Field of Search ..... 238/349, 264, 287, 294, 238/295, 296, 310, 337, 375

[56] References Cited

U.S. PATENT DOCUMENTS

| | | | |
|---|---|---|---|
| 3,834,620 | 9/1974 | Barlett | 238/349 |
| 3,982,692 | 9/1976 | Feyrer et al. | 238/349 |
| 4,179,067 | 12/1979 | Baier | 238/349 |

*Primary Examiner*—Richard A. Bertsch

*Attorney, Agent, or Firm*—Neuman, Williams, Anderson & Olson

[57] ABSTRACT

An assembly is provided for securing a rail to a supporting tie and includes upper and lower plate members engaging corresponding tie surfaces. The upper plate member is interposed the base of the rail and the tie upper surface. A portion of the upper plate member projects outwardly from the rail base and is apertured. The aperture is aligned with a hole in the tie extending transversely between the corresponding tie surfaces. The lower plate member is provided with a slotted aperture aligned with the tie hole. A resilient clip overlies the upper plate member apertured portion and includes apertured inner and outer sections disposed in resiliently spaced relation. Apertures in the clip sections are aligned with one another and the upper plate member aperture. A lock element is provided having a head end, a distal end, and a shank interconnecting the ends. The distal end has lateral extensions. The aligned apertures of the clip and the upper plate member and the tie hole are sized to accommodate the shank, distal end, and extensions of the lock element adjacent the distal end. The extensions are passable through the lower plate member slotted aperture only when in slot-registered relation with the slotted aperture. The slot-registered extensions pass through the slotted aperture when a predetermined compressive force is applied to the head end and lock with lower surface portions of the lower plate member when a predetermined twisting force is applied to the head end.

15 Claims, 8 Drawing Figures

FIG. 1
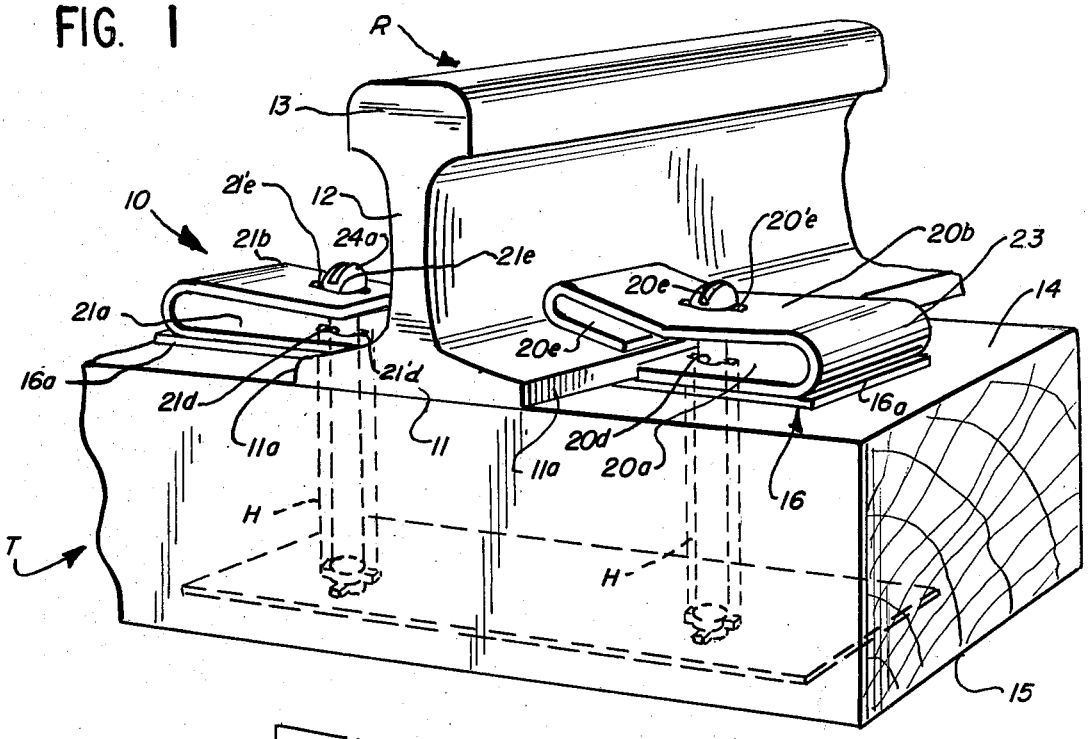
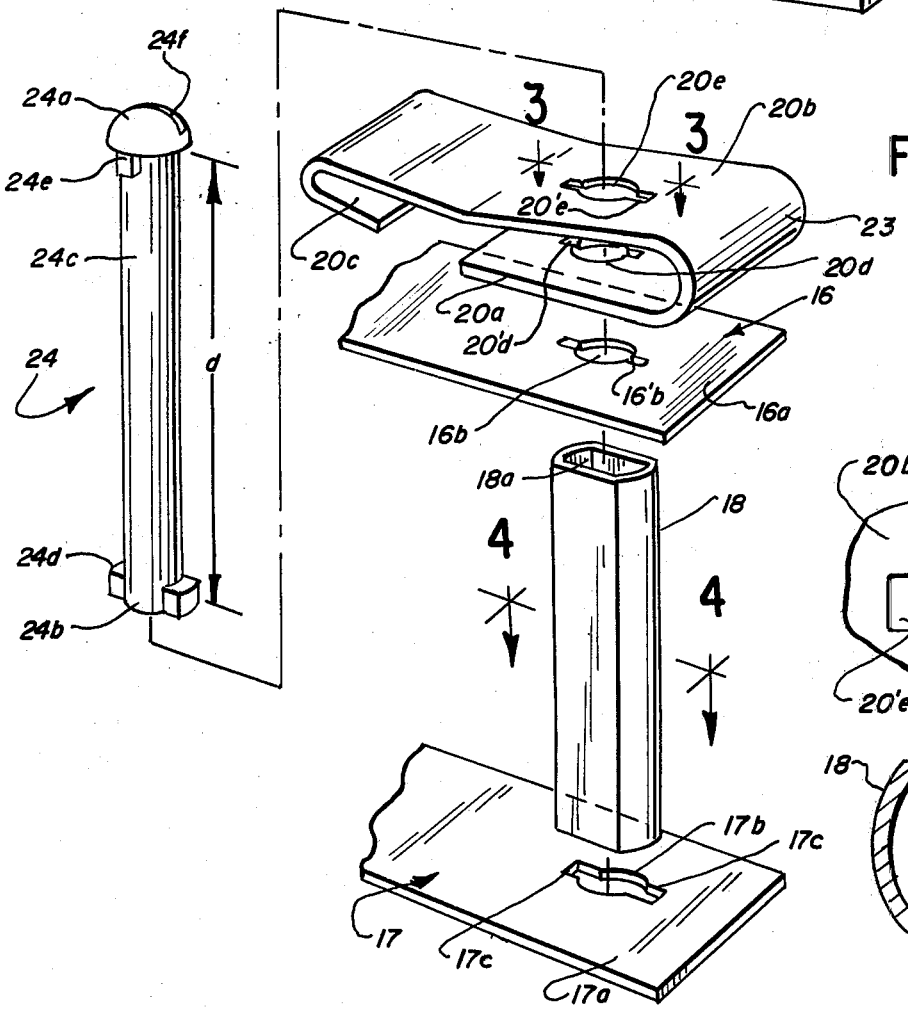
FIG. 2
FIG. 3
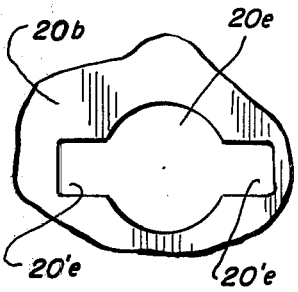
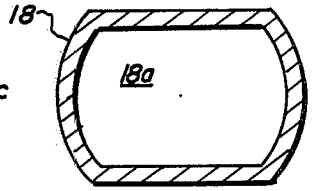
FIG. 4

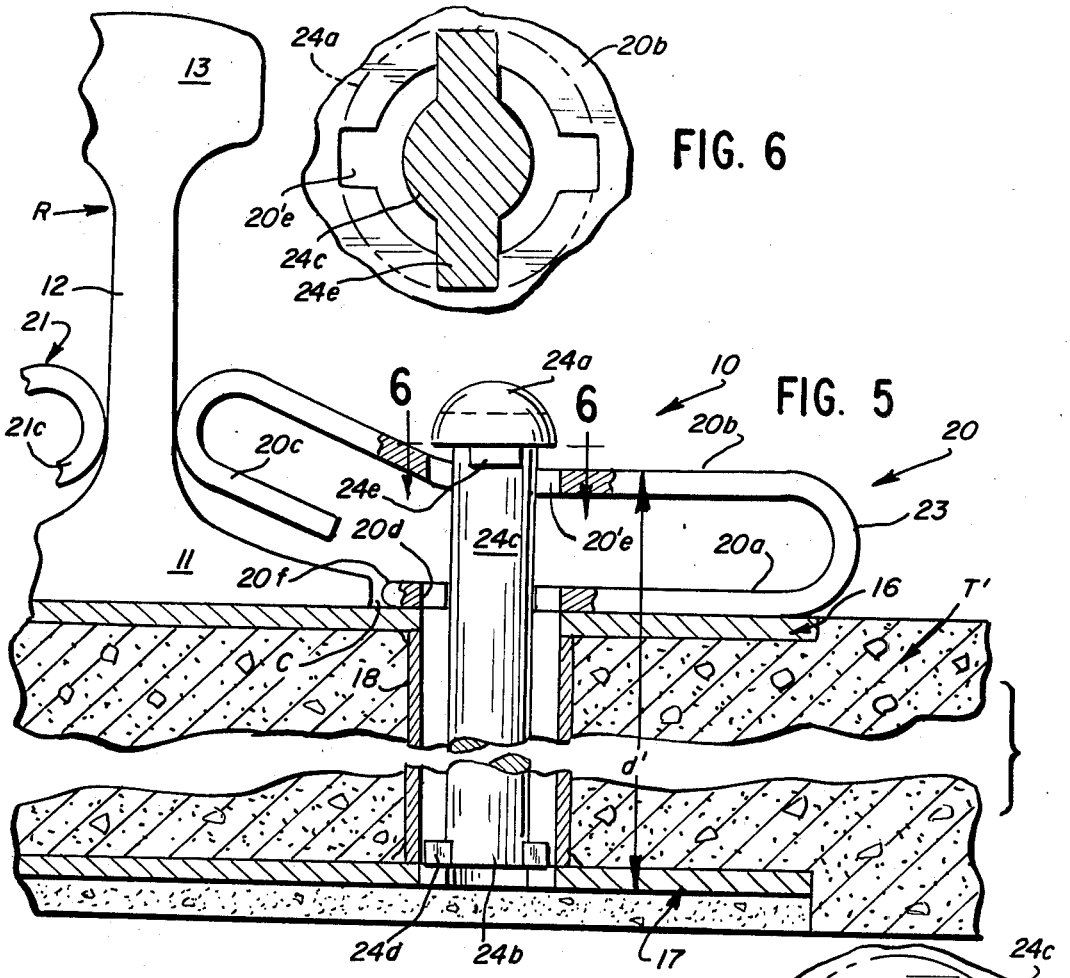
FIG. 6
FIG. 5
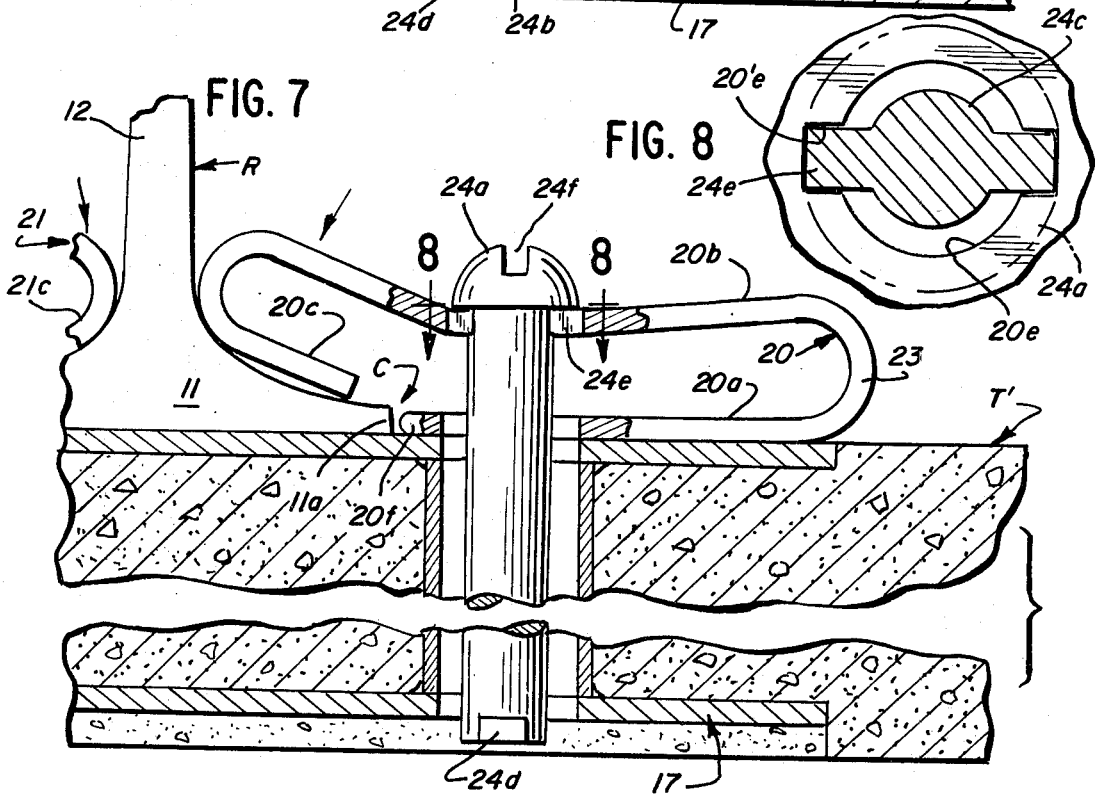
FIG. 7
FIG. 8

ASSEMBLY FOR SECURING A RAIL TO A SUPPORTING TIE

BACKGROUND OF THE INVENTION

This invention is the subject matter of Disclosure Document No. 083980, filed in the U.S. Patent and Trademark Office on behalf of applicant on Sept. 4, 1979.

Track maintenance for railroads and the like has always been a costly and time-consuming operation involving an inordinate amount of manual labor. Such maintenance however is essential in order to assure safe, efficient, smooth, and expeditious movement of trains along the track. Customarily, the track includes a pair of steel rails arranged in a predetermined spaced parallel relation with the base of the rails secured to and supported by a plurality of wooden cross ties substantially uniformly spaced along the rails. The ties rest up a road bed normally formed of a layer of crushed stone or rock called ballast. Securement of the base of each rail to the tie is normally effected by a rail plate which subtends a portion of the rail base and is disposed within an adzed recess formed in the upper surface of the tie. The upper surface of the rail plate is provided with a recessed area sized to receive the bottom surface of the rail base. Suitable openings are formed in the rail plate to receive spikes which are driven into the tie and secure the rail plate to the tie. The location of certain of the openings in the rail plate is such that the spikes accommodated in the openings will have the heads thereof overlying and pressing against an adjacent toe or peripheral portion of the rail base.

Because of the tendency of the rails to spread apart when a train moves over the track, it has been customary, in the past, to utilize lateral rail anchors and gauge bars in conjunction with the ties and rail plates to resist such relative movement and to maintain the rails in proper parallel spaced relation.

Oftentimes to expedite and/or to minimize material and labor costs involved in track maintenance, potentially dangerous track conditions are created due to (a) a minimum number (e.g., a single spike) of spikes being utilized to secure the rail plate and rail to the tie surface; (b) the spikes are not driven to their fullest extent into the supporting tie; and (c) the spike-holding power of the tie is weak and ineffective due to the age and physical condition of the supporting tie. Under any of these conditions and depending upon the amount and speed of the traffic moving over the track, the rail and rail plate will in a relatively short period of time cause increased relative movement of the rail with respect to the tie due to traffic vibrations and/or expansion and contraction of the components caused by temperature variations resulting in misalignment of the rails and ultimately a derailment.

Heretofore in an effort to reduce the occurrence of these conditions and the hazards associated therewith, various forms of rail hold-down devices or assemblies have been proposed; however, because of certain inherent design characteristics they have been beset with one or more of the following shortcomings: (1) the device or assembly was of a costly and complex construction; (2) attachment of the device or assembly to the rail and tie was an awkward and difficult manipulation or procedure oftentimes requiring the talents of highly-skilled and experienced labor; (3) the device or assembly was not capable of being used with various types and sizes of ties and rails; (4) the device or assembly required an inordinate number of customized accessories to effect proper securement of the rail to the tie; (5) the device or assembly could not be readily removed from the tie or rail, when required, without causing serious mutilation, defacement, and damage to the rail and/or tie; and (6) the device or assembly was susceptible to vandalism and sabotage.

SUMMARY OF THE INVENTION

Thus, it is an object of the invention to provide an improved rail-securing assembly which readily avoids each of the aforenoted shortcomings.

It is a further object of the invention to provide an improved assembly which may be readily utilized with either wooden or concrete ties.

It is a still further object of the invention to provide an improved assembly which does not rely on the spike-holding power of the tie in order to effectively secure the rail to the tie.

It is a further object of the invention to provide an improved assembly wherein the hold-down force exerted on the rail is substantially uniform and will remain so over a prolonged period of time.

It is a further object of the invention to provide an improved assembly which is capable of compensating for expansion or contraction of the rail while still maintaining an effective and safe hold-down force being applied to the rail.

Lastly, it is an object to provide an improved assembly which eliminates the need for gauge bars, spikes, and lateral rail anchors and significantly expedites and facilitates the laying of track.

Further and additional objects will appear from the description, accompanying drawings, and appended claims.

In accordance with one embodiment of the invention, an improved assembly is provided for securing a rail to a supporting tie. The assembly includes upper and lower plate members which are adapted to engage top and bottom surfaces of the supporting tie. The upper plate member is interposed the base of the rail and the tie top surface. Portions of the upper plate member project outwardly from opposite sides of the rail base and each is provided with an aperture. The aperture is aligned with one end of a hole formed in the tie and extending transversely from the top surface to the bottom surface. The lower end of the hole is aligned with a slotted aperture formed in the lower plate member. The upper and lower plate members are in substantially registered relation. Disposed within the tie hole is a sleeve member which spans the distance between the plate members. A clip is mounted on each apertured portion of the upper plate member and is provided with an apertured inner section, which engages the apertured portion of the upper plate member, and an apertured outer section. The outer section has a portion thereof which is adapted to overlie a segment of the rail base. The clip outer section is in resiliently spaced registered relation with the inner section and the apertures of the sections are in aligned relation.

Extending through the aligned apertures of the clip and the upper plate member and the sleeve member and the slotted aperture of the lower plate member is an elongated lock element. The lock element includes an enlarged head end, a distal end, a shank interconnecting the two ends, and sets of lateral extensions; one set being disposed adjacent the distal end and the second set being disposed adjacent the head end. The sets of extensions are angularly displaced. The aligned apertures of the clip and upper plate member, the sleeve member, and the slotted aperture of the lower plate member are sized so as to permit the shank, the distal end, and the distal end extensions of the lock element to pass therethrough when the assembly is securing the rail to the tie. The distal end and extensions thereof pass through the slotted aperture of the lower plate member only when the extensions are in a slot-registered relation and a predetermined compressive force is applied to the head end of the lock element. When the extensions have passed through and cleared the slotted aperture, and while the predetermined compressive force is being applied, a twisting force is also applied to the head end whereby the distal end extensions engage the lower surface portions of the lower plate member circumjacent the slotted aperture upon release of the compressive force. While the extensions are in such engagement with the lower surface portions of the lower plate member, the lock element is in a locking mode whereby the rail base is securely held against the supporting tie by the portion of the clip outer section which overlies the segment of the rail base. The aperture in the outer section of the clip is slotted so as to accommodate the set of extensions adjacent the head end when the twisting force is applied to the head end to move the lock element into its locking mode. When the second set of extensions is accommodated in the slots, the lock element is restrained from further twisting.

Thus, when the lock element is in its locking mode, it is locked against twisting by the second set of extensions and against being withdrawn longitudinally by the first set of extensions.

DESCRIPTION

For a more complete understanding of the invention, reference should be made to the drawings wherein:

FIG. 1 is a fragmentary perspective end view showing one form of the improved assembly securing a section of rail to a supporting tie.

FIG. 2 is a fragmentary perspective view of the assembly of FIG. 1, but with the components thereof in exploded relation.

FIG. 3 is an enlarged fragmentary top view of the aperture formed in the outer section of the assembly clip.

FIG. 4 is an enlarged sectional view of the assembly sleeve member taken along line 4—4 of FIG. 2.

FIG. 5 is an enlarged fragmentary sectional view taken normal to the longitudinal axis of the rail and showing the assembly in combination with a concrete tie and with the lock element in a non-locking mode.

FIG. 6 is an enlarged fragmentary sectional view taken along line 6—6 of FIG. 5.

FIG. 7 is similar to FIG. 5, but showing the lock element in a locking mode.

FIG. 8 is an enlarged fragmentary sectional view taken along line 8—8 of FIG. 7.

Referring now to the drawings and more particularly to FIG. 1, one form of the improved assembly 10 is shown securing a conventional railroad rail R to a wooden supporting tie T, also of conventional design. The rail R is formed of steel and normally comes in either a straight or curved section of a predetermined length. The rail sections may be either welded together in end-to-end relation, or bolted or riveted together by utilizing splicing plates which interconnect the adjoining rail sections in a manner well known in the art.

Each rail section is of conventional design and includes a base 11, a centrally disposed web 12 which extends upwardly from the base and terminates in an enlarged head 13, the latter providing the running surface for the flanged wheels, not shown, of the rolling stock.

The rail base 11 is supported by a plurality of ties T of wooden, concrete, or other suitable material which are disposed transversely of the rail and are disposed in a substantially parallel predetermined spaced relation. Each tie, in turn, is normally supported on a bed of crushed stone or rock, commonly referred to as ballast. The ballast provides stability and drainage for the ties and distributes the load to which the tie is subjected.

The top and bottom surfaces 14, 15, respectively, of the tie are substantially planar. Where the tie is wooden, it is normally treated with a preservative material so that the tie is capable of withstanding severe changes in climate.

The improved assembly 10, as illustrated, includes upper and lower plate members 16, 17 which are of similar configuration and engage, respectively, the top and bottom surfaces 14, 15 of the tie T. The plate members are disposed in substantially parallel registered relation. Each plate member is disposed substantially perpendicular to the longitudinal axis of the rail and has a length substantially greater than the width of the rail base 11. The upper plate member 16 is interposed the rail base 11 and the tie top surface 14, as seen more clearly in FIG. 1. The portions 16*a*, 17*a* of the plate members which project beyond the side edges 11*a* of the rail base are each provided with an aperture 16*b*, 17*b*. The apertures 16*b* of the upper plate member 16 are disposed proximate, but spaced from, the corresponding side edges 11*a* of the rail base.

The corresponding apertures 16*b*, 17*b* of the plate members 16, 17 are vertically aligned with opposite ends of a metallic sleeve member 18, see FIG. 2, which is sized so as to slidably fit within a hole H formed in the tie and extending transversely between the top and bottom surfaces thereof. The tie holes H are normally formed in the tie before the latter is delivered to the track site and thus, the tie is pre-gauged thereby facilitating laying of the rail sections. Prior to the sleeve members being fit into the tie holes, one end of each sleeve member is welded or otherwise attached to the lower plate member 17 so as to be aligned with the apertures 17*b* formed therein.

Overlying the projecting portions 16*a* of the upper plate member 16 are a pair of metallic clips 20, 21 which are preferably of like configuration and disposed on opposite sides of the rail. Each clip includes an inner section 20*a*, 21*a* which rests upon the projecting portion 16*a* of the plate member. Disposed in resiliently spaced overlying relation with the inner section is an outer section 20*b*, 21*b*. A corresponding end of each section, furthest removed from the side edge 11*a* of the rail base 11, is interconnected by a bail section 23. The opposite end of the outer section 20*b*, 21*b* projects over the upper surface of the rail base 11 and is bent so as to form a depending outwardly extending tongue 20*c*, 21*c*. When the assembly is in a rail-securing condition, as seen in FIG. 7, the tongue 20*c*, 21*c* will firmly press against the upper surface of the rail base and secure the latter to the tie. Because of the tortuous configuration of each clip, the outer section 20*b*, 21*b* will flex towards the inner section 20*a*, 21*a* when a predetermined compressive force (e.g., 7 tons) is applied to an elongated lock element or pin 24 to effect securement of the rail to the tie, as will be described more fully hereinafter.

The outer and inner sections of each clip are provided with an aperture 20*d*, 20*e*, and 21*d*, 21*e*. The apertures in each clip are in vertical alignment with each other and with the aperture 16*b* of the upper plate member 16. As seen in FIGS. 2 and 3, the apertures 20*e*, 21*e* of the outer section of the clip, the apertures 20*d*, 21*d*, of the inner section of the clip, and the opening 16*b* of the upper plate member 16 are preferably slotted with the slots 20′*e*, 21′*e*; 20′*d*, 21′*d*; and 16′*b* thereof arranged in diametrically opposed relation and aligned at a substantially right angle to the web 12 of the rail R. The purpose of the slotted apertures of the clips and the slotted apertures 16*b*, 17*b* of the upper and lower plate members will become apparent from the description hereinafter.

Lock element 24, as seen more clearly in FIG. 2, includes a head end 24*a*, a distal end 24*b*, a shank 24*c* connecting the two ends, a first set of lateral extensions 24*d* adjacent the distal end, and a second set of lateral extensions 24*e* adjacent the head end 24*a*. The head end 24*a*, in the illustrated embodiment, is enlarged and has a semi-spherical configuration with a diametrically disposed groove or slot 24*f* formed therein. The groove is shaped to accommodate the tip of a heavy-duty screwdriver or similar turning tool so that a twisting force can be applied to the lock element to actuate same into a locking mode, as seen in FIG. 7. The direction of groove 24*f*, as seen in FIG. 2, is preferably substantially the same as the direction of the first set of extensions 24*d* for reasons to be hereinafter explained. In lieu of the semi-spherical configuration of the head end 24*a*, the latter may be square, hexagonal or the like so as to accommodate the jaws of a wrench or similar turning tool. This embodiment may also include a slot or groove for receiving a turning tool so that alternative techniques may be employed for rotating the lock element. Whatever the shape of the head end 24*a*, it must be impassable with respect to the slotted aperture 20*e*, 21*e* formed in the clip outer section 20*b*, 21*b*.

When the rail is to be secured by the clips 20, 21 to the tie T, the distal end 24*b* and extensions 24*d* are oriented relative to the slotted aperture 20*e*, 21*e* so that the extensions 24*d* are in registration with the aperture slots 20′*e*, 21′*e*. The sizing of the clip apertures, the plate member apertures, and the interior 18*a* of the sleeve member 18 is such that the distal end 24*b*, the extensions 24*d*, and the shank 24*c* may pass therethrough provided the extensions 24*d* are properly oriented with the slots 17*c* of the plate member aperture 17*b*.

The spacing d (see FIG. 2) between the underside of the head end 24*a* and the opposing surfaces of the extensions 24*d* of the lock element 24 is less than the distance d′ (see FIG. 5) between the upper exposed surface of the clip outer section 20*b*, when in a non-flexed condition, and the under surface of the lower plate member 17. Thus, in order for the slot-registered extensions 24*d* to pass through the aperture 17*b* of plate member 17, it is necessary for the outer section 20*b*, 21*b* of the clip 20, 21 to be flexed towards the clip inner section 20*a*, 21*a* an appropriate amount by the application of the aforementioned compressive force on the head end 24*a* of the lock element. Once the extensions 24*d* have moved past the aperture 17*b*, a predetermined twisting force is also applied to the head end thereby causing the extensions 24*d* to move out of registry with the slots 17*c* and engage the lower surface portions of the plate member 17, circumjacent the aperture 17*b*, upon release of the compressive force.

As aforementioned, the lock element extensions 24*d*, 24*e* are angularly disposed relative to one another so that when the proper amount of twisting force has been applied to the head end 24*a*, the second set of extensions 24*e* will become registered with the slots 20′*e*, 21′*e* of clip aperture 20*e*, 21*e* and upon release of the compressive force on the head end 24*a*, the extensions 24*e* will become accommodated in the aperture slots 20′*e*, 21′*e* and hold the lock element 24 in its locking mode, FIG. 1. Because of the substantial resistance of the clip to flexure, a very substantial hold-down force is exerted on the rail base by tongue 20*c*, 21*c* of the clip.

In FIGS. 5 and 7, the improved assembly 10 is shown utilized with a tie T′ which is formed of concrete or some other suitable hardenable material. With such type of tie, the upper and lower plate members 16 and 17 may be welded or otherwise secured to opposite ends of the sleeve member 18 so as to form a unitary structure which is molded into the tie itself at the time it is poured. Thus, when the tie T′ is delivered to the track site, it is pre-gauged with the plate members and sleeve member already in place. It will be noted in FIGS. 5 and 7, that the exposed surface of plate member 16 is substantially flush with the surrounding top surface of the tie T′. On the other hand, the lower plate member 17 is preferably recessed from the surrounding bottom surface of the tie by an amount sufficient to enable the lock element extensions 24*d* to clear the aperture 17*b* without interference from the bed, not shown, on which the tie rests.

Where the tie material is sufficiently hard and wear-resistant, the sleeve member 18 may not be required, however, in most instances it is preferred. Also, if desired, the second set of extensions 24*e* may be eliminated and the friction existing between the underside of the lock element head end 24*a* and the clip outer section, when the lock element is in its locking mode, may be sufficient to retain the lock element in its locking mode.

In place of, or in addition to, the groove 24*f* formed in the head end of the lock element 24, a magnetic field may be induced upon a portion of the head end with the direction of the field being correlated to the directions the extensions 24*d* project from the shank axis. Thus, with the head end of each lock element so magnetized, the relative positions of the extensions 24*d* of each lock element with respect to the slots 17*c* of the slotted aperture 17*b* of the lower plate member 17 can be readily determined by the use of a simple sensing device, not shown, as the latter moves across and above the head end. If desired, the sensing device, which may be of conventional design, can be mounted on a suitable vehicle which runs along the rails and thereby enabling a substantial length of track to be checked in a simple, yet expeditious, manner.

As will be noted in FIGS. 5 and 7, there is a small amount of clearance C provided between the side edge 11*a* of the rail base 11 and the edge 20*f* of the clip inner section 20*a*. This clearance compensates for any expansion of the rail base 11 which might occur under certain climatic conditions. Furthermore, because of the manner in which the tonque 20*c*, 21*c* of the clip 20, 21 is bent back under the remainder of the outer section 20*b*, 21*b*, expansion and contraction or vibration of the rail can be absorbed without serious nicking or scarring of the rail which might otherwise adversely affect the durability of the rail.

When for any reason it is necessary to replace the tie or rail section, the lock element can be readily actuated to its non-locking mode by applying the predetermined compressive force to the outer section 20*b*, 21*b* of the clip so as to relieve the pressure on the lock element head end and enable the second set of extensions 24*e* to be moved out of the slots 20'*e*, 21'*e* and thus permit a twisting force to be applied to the head end until the first set of extensions 24*d* are aligned with the slots 17*c* of the lower plate member 17. When the extensions 24*d* are so aligned the lock element 24 can then be readily withdrawn from the sleeve member, plate members and the clip. Because a substantial compressive force is required to release the extensions 24*e* from the slotted aperture in the outer section of the clip, the possibility of loosening the clip without utilizing a special tool for this purpose, significantly reduces the incidents of vandalism and sabotage of the track.

The amount of compressive force which must be applied in order to actuate the lock element to either the locking or non-locking mode, will depend upon the material, size, and shape of the clip and the relative dimensions of the lock element, clip, and tie thickness. A suitable safety factor should be engineered into the clip design so that a substantially-greater compressive force could be applied to the clip than is required to actuate the lock element between its locking and non-locking modes without exceeding the elastic limits of the clip.

Thus, it will be seen that an improved rail hold-down assembly has been provided which is of simple construction, is not adversely affected by expansion and contraction or vibration of the rails, and eliminates the need for gauge bars, lateral rail anchors, and the like. The securement of the assembly with respect to the rail and tie does not rely upon the spike-holding strength of the tie. Detection of an improperly mounted lock element in the improved assembly can be readily determined either visually or by a magnetic sensor, thereby safely expediting track maintenance.

I claim:

1. An assembly for securing the base of a rail to a supporting tie, comprising a first plate member adapted to be interposed the rail base and an adjacent first surface of the tie, a segment of the plate member protruding outwardly from the rail base and provided with an aperture; a second plate member in spaced substantially registered relation with said first plate member and adapted to engage an opposing second surface of the tie, said second plate member provided with a slotted aperture, said plate member apertures adapted to be aligned with opposite ends of an elongated hole formed in the tie and extending transversely of the surfaces; a clip having an apertured inner section and an apertured outer section arranged in resilient spaced relation with respect thereto, said inner section engaging the outwardly protruding segment of said first plate member, said inner section having an aperture aligned with said first plate member aperture, and the outer section having a portion for engaging the rail base and retaining same against said first plate member, said outer section having an aperture aligned with said inner section aperture; and a locking element adjustable between locking and non-locking modes and having a head end and a distal end interconnected by an elongated shank, the latter and said distal end being sized to pass through the aligned apertures of said clip and said plate members and the tie hole, the head end being impassable with respect to the clip outer section aperture, the distal end including transverse extensions passable through the slotted aperture of said second plate member only when the extensions are in a slot-registered relation with respect to said slotted aperture and said lock element is in a non-locking mode; said lock element being actuated to a locking mode only when the extensions are in a slot-registered relation, a predetermined compressive force is applied to the head end of the lock element causing said distal end and the extensions to pass through the slotted aperture of said second plate member, and a predetermined twisting force is subsequently applied to the head end causing the extensions to slidably engage surface portions of the second plate member circumjacent the slotted aperture.

2. The assembly of claim 1 wherein the head end of the lock element includes means for determining the relative location of said extensions with respect to the circumjacent surface portions of said second plate member, when said lock element is in a locking mode.

3. The assembly of claim 2 wherein the head end means of said lock element includes an elongated indicia provided on the exposed surface of said head end, said indicia being in a predetermined correlated relation with the extensions of said distal end.

4. The assembly of claim 3 wherein the distal end extensions are substantially diametrically opposed to one another, and the head end indicia includes an elongated groove formed in the exposed surface of said head end, said groove being disposed in spaced substantially parallel relation with respect to said extensions.

5. The assembly of claim 2 wherein the head end means of said lock element includes inducing a predetermined permanent magnetic field on a predetermined portion of said head end, the direction of said magnetic field being correlated to the directions the extensions project from the distal end of said lock element.

6. The assembly of claim 1 wherein a sleeve member extends from the first plate member to the second plate member and is affixed to at least one of said plate members, said sleeve member adapted to be accommodated in the tie hole and sized to permit the shank, distal end and extensions of said lock element to pass therethrough.

7. The assembly of claim 6 wherein the first and second plate members and the sleeve member are adapted to be permanently attached to the tie.

8. The assembly of claim 6 wherein the sleeve member has the opposite ends thereof fixedly attached to said plate members, and said sleeve member and said plate members are adapted to be embedded in a tie formed of a hardenable material.

9. The assembly of claim 1 wherein second extensions are formed on the shank adjacent the head end of the lock element; the aperture formed in the outer section of the clip being slotted, said second extensions being accommodated in the latter slotted aperture only when said lock element is disposed in a locking mode.

10. The assembly of claim 9 wherein the second extensions are angularly oriented relative to the distal end extensions.

11. The assembly of claim 10 wherein the lock element is of unitary construction.

12. The assembly of claim 10 wherein the distal end extensions are substantially diametrically opposed to one another, and the second extensions are substantially diametrically opposed to one another.

13. The assembly of claim 1 wherein the longitudinal spacing between the opposing surfaces of said head end and said distal end extensions is substantially less than the distance measured, without compressive force being applied to the head end, between the exposed surface of the clip outer section and the surface of the second plate member slidably engaged by the distal end extensions.

14. The assembly of claim 1 wherein the second plate member is adapted to be permanently attached to the second surface of the tie.

15. The assembly of claim 1 wherein the outer and inner sections of the clip form a unitary structure and the outer section is in substantially superincumbent relation with said inner section.

* * * * *